US006211849B1

(12) United States Patent
Sasaki et al.

(10) Patent No.: US 6,211,849 B1
(45) **Date of Patent: *Apr. 3, 2001**

(54) LIQUID CRYSTAL DISPLAY DEVICE

(75) Inventors: Takeshi Sasaki; Kan Shimizu, both of Tokyo (JP)

(73) Assignee: Kabushiki Kaisha Toshiba, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/936,515

(22) Filed: Sep. 24, 1997

(30) Foreign Application Priority Data

Sep. 24, 1996 (JP) ..... 8-251593

(51) Int. Cl.[7] ..... G09G 3/20; G09G 3/36

(52) U.S. Cl. ..... 345/55; 345/87; 345/90; 345/98

(58) Field of Search ..... 345/80, 55, 87, 345/92, 93, 98, 99, 100, 150; 327/149

(56) References Cited

U.S. PATENT DOCUMENTS 5,164,970 * 11/1992 Shin et al. ..... 345/87
5,508,728 * 4/1996 Ishjima et al. ..... 347/211
5,543,819 * 8/1996 Farwell et al. ..... 345/150
5,585,816 * 12/1996 Scheffer et al. ..... 345/100
5,729,316 * 3/1998 Yamamura et al. ..... 345/100
5,751,279 * 5/1998 Okumura ..... 345/212
5,805,003 * 9/1998 Hsu ..... 327/149

* cited by examiner

*Primary Examiner*—Steven Saras
*Assistant Examiner*—Alecia D. Nelson
(74) *Attorney, Agent, or Firm*—Pillsbury Winthrop

(57) ABSTRACT

A liquid crystal display device is composed of a liquid crystal panel having a matrix array of liquid crystal pixels, a plurality of scanning lines formed along rows of the liquid crystal pixels, and a plurality of signal lines formed along columns of the liquid crystal pixels, and a display control circuit for selecting a row of the liquid crystal pixels via each of the scanning lines and controlling voltages across the liquid crystal pixels of the selected row via the signal lines. The display control circuit includes a signal line driver for sequentially driving the signal lines, and the signal line driver includes a plurality of driver ICs which are connected in cascade by inter-module wirings for transmitting a clock signal and a pixel data signal and each of which sequentially supplies the pixel data signal to a predetermined number of signal lines in synchronism with the clock signal. Particularly, in the liquid crystal display device, each driver IC has a clock waveform shaping circuit for performing a clock signal waveform shaping by regulating a duty ratio of the clock signal to be output together with the pixel data signal to the next driver IC.

4 Claims, 5 Drawing Sheets

LIQUID CRYSTAL DISPLAY DEVICE

BACKGROUND OF THE INVENTION

The present invention relates to a liquid crystal display device having a structure in which a plurality of liquid crystal pixels are arranged in matrix, and more specifically to a driving circuit for controlling voltages across these liquid crystal pixels to display an image.

An active matrix liquid crystal device generally includes a liquid crystal panel having a structure in which a liquid crystal layer is interposed between an array substrate and a counter substrate opposing thereto. Each of the array substrate and the counter substrate has a transparent glass plate used as a base material, and the liquid crystal layer has a liquid crystal composition filled in the space between the array substrate and the counter substrate. The array substrate includes a matrix array of pixel electrodes, scanning lines respectively formed along the rows of these pixel electrodes, signal lines respectively formed along the columns of these pixel electrodes, Thin Film Transistors (TFTS) respectively formed at positions close to the intersections of the scanning lines and the signal lines, and each serving as a switching element for electrically connecting one signal line to one pixel electrode in response to a selection signal from one scanning line, a scanning line driver for supplying the selection signal to the scanning lines and a signal line driver for supplying pixel data signals to the signal lines. In the liquid crystal display device, an image is displayed according to potential differences between the pixel electrodes and a common electrode.

For example, the signal line driver is composed of driver ICs arranged as shown in FIG. 1. These driver ICs are connected to common bus lines including power lines VDD and GND, data lines DATA and control signal lines CNT. The driver ICs are arranged together with the common bus lines on a driver substrate provided near the periphery of a liquid crystal panel.

With regard to the liquid crystal display device having the above-described driver substrate, an increase in the dimensions of the frame region of the liquid crystal panel is required in order to obtain a larger size of screen or a higher resolution. Therefore, the COG (chip on glass) mount technique has been proposed in order to eliminate the drive substrate. According to this technique, thin film wirings are formed such as to be in contact with connection terminals exposed on the glass surface of the array substrate, and bare chips of driver ICs are soldered to the thin film wirings.

However, since a thin film wiring formed by the present COG mount technique, has a relatively high resistance, it is difficult to reduce the width of the wiring. This drawback causes an increase in the dimensions of the frame region of the liquid crystal panel. Further, generally, in the manufacture of liquid crystal panels, a plurality of array substrates are obtained from one glass plate. That is, circuit components of each array substrate are formed in one region which is obtained by partitioning the glass plate. In the case where all the thin film wirings are arranged within the array substrate, the area occupied by each array substrate is increased, and therefore a larger glass plate is required. In other words, the number of array substrates obtained from one glass plate is decreased. This results in an increase in the manufacturing cost for the liquid crystal panel. Alternatively, it is possible that only those of the thin film wirings which correspond to the common bus lines are formed on an external print wiring board; however the use of such a print wiring board may cause an increase in the manufacturing cost. For example, when the common bus line is elongated, it becomes difficult to transmit a signal at high speed since the elongation increases the parasitic capacitance which makes the waveform of the transmitted signal dull. Further, it becomes more likely that unnecessary radio waves are radiated from the common bus lines on the print wiring board. Consequently, shield layers or terminal resistances are additionally required to reduce the radiation of unnecessary radio waves.

Furthermore, it is possible that a plurality of driver ICs are formed on an array substrate by the COG mount technique, and thin films are formed as inter-module wirings between driver ICs, in order to prevent an increase in the dimensions of the frame region and in the manufacturing cost. The inter-module wirings serve to connect the driver ICs in cascade, and transmit signals via each driver IC. However, such a structure provides only a low signal transmission speed in which the clock frequency is set about 5 MHz. According to an experiment, the pulse width of a clock signal is decreased by 40 ns at worst each time the clock signal passes one driver IC. Therefore, in order to ensure a normal signal transmission, the number of driver ICs connected in cascade must be limited to about 10 at most.

BRIEF SUMMARY OF THE INVENTION

An object of the present invention is to provide a liquid crystal display device capable of achieving a larger screen size or a higher resolution, without unnecessarily increasing the dimensions of the frame region and the manufacturing cost.

According to the present invention, there is provided a liquid crystal display device which includes a liquid crystal panel having a matrix array of liquid crystal pixels, a plurality of scanning lines formed along rows of the liquid crystal pixels, and a plurality of signal lines formed along columns of the liquid crystal pixels; and a driving circuit for driving each of the scanning lines to select a row of the liquid crystal pixels and driving the signal lines to control voltages across the liquid crystal pixels of the selected row; wherein the driving circuit includes a signal line driver for sequentially driving the signal lines, and the signal line driver includes a plurality of driver ICs which are connected in cascade by inter-module wirings for transmitting at least a clock signal and a display signal and each of which sequentially supplies the display signal to a predetermined number of signal lines in synchronism with the clock signal, and each driver IC has a clock waveform shaping circuit for performing a clock signal waveform shaping by regulating a duty ratio of the clock signal to be output together with the display signal to a next stage.

In the liquid crystal display device, the clock signal waveform shaping circuit of each driver IC performs a clock signal waveform shaping by regulating the duty ratio of the clock signal. With this structure, it becomes possible to maintain a transmission capability regardless of an increase in the number of driver ICs. For example, in the case where a plurality of driver ICs are incorporated in a liquid crystal panel by the COG mount technique and they are connected in cascade by inter-module wirings of a high-resistance thin film, a normal signal transmission can be attained even if the widths of the inter-module wirings are maintained small for avoiding an unnecessary increase in the dimensions of the frame region and the manufacturing cost of the liquid crystal panel.

Specifically, with the liquid crystal display device, a high signal transmission speed in which the clock frequency is set about 25 MHz to 65 MHz, can be achieved. Consequently, ten or more driver ICs can be connected in cascade so as to obtain a larger screen size or a higher resolution.

DETAILED DESCRIPTION OF THE INVENTION

An active matrix liquid crystal display device according to an embodiment of the present invention will now be described with reference to accompanying drawings.

Figure 1:
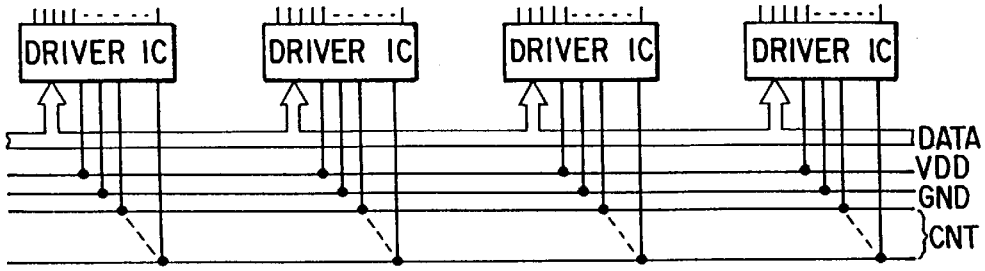
FIG. 1 (PRIOR ART)
FIG. 1 is a block diagram schematically showing the structure of a signal line driver of a conventional liquid crystal display device.
Figure 2:
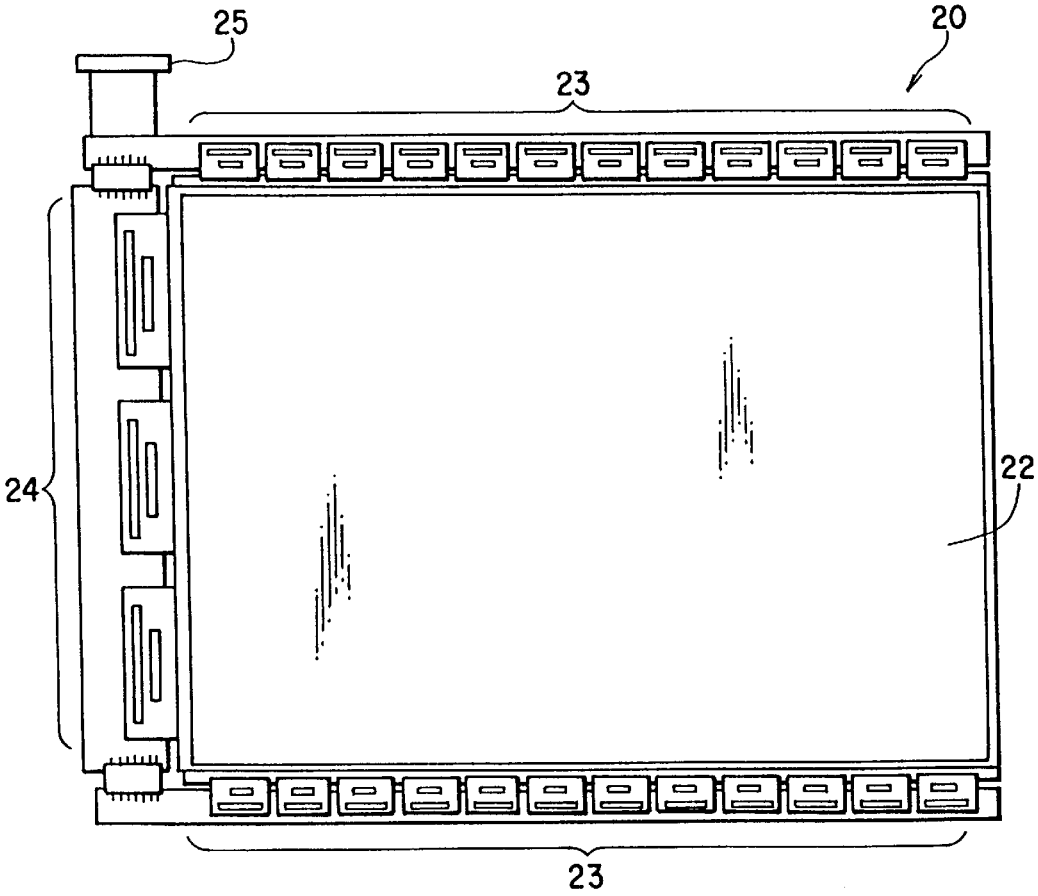
FIG. 2 is a plan view schematically showing an active matrix liquid crystal display device according to an embodiment of the present invention.

FIG. 2 schematically shows the plan structure of the liquid crystal display device 20. The liquid crystal display device 20 includes a liquid crystal panel 22 in which a liquid crystal layer is held between an array substrate and a counter substrate, and a display control circuit for controlling the voltages across liquid crystal pixels of the liquid crystal panel 20. Each of the array substrate and the counter substrate has a transparent glass plate used as a base material, and the liquid crystal layer has a liquid crystal composition filled in a gap between the array substrate and the counter substrate. The array substrate includes a matrix array of pixel electrodes, a plurality of scanning lines formed along rows of the pixel electrodes, a plurality of signal lines formed along columns of the pixel electrodes, and a plurality of Thin Film Transistors (TFTs) formed at positions close to intersections between scanning lines and signal lines, and serving as switching elements. Each TFT has a gate connected to one scanning line, and a current path connected between one signal line and one pixel electrode, and is used to electrically connect the signal line to the pixel electrode in response to a selection signal from the scanning line. The display control circuit includes an interface unit 25 for entering a power voltage, a pixel data signal, a clock signal and other control signals, supplied from an external liquid crystal controller, a scanning line driver 24 for receiving the power voltage and the control signals from the interface unit 25. The display control circuit performs at the power voltage, an operation of sequentially supplying a selection signal to the scanning lines under the control of the control signal, and includes a pair of signal line drivers 23 for receiving the power voltage, the pixel data signal, the clock signal and the control signals entered by the interface unit 25 to perform at the power voltage an operation of sequentially supplying the pixel data signal to the signal lines in synchronism with the clock signal under the control of the control signal. The drivers 23 and 24 are formed on driver substrates provided near the periphery of the liquid crystal panel 22. The scanning line driver 24 is connected to the scanning lines, and the pair of signal line drivers 23 are respectively connected to the odd-numbered signal lines and to the even-numbered signal lines. In the liquid crystal display device, an image is displayed according to potential differences between the pixel electrodes and a common electrode which oppose to each other via the liquid crystal layer to form a matrix array of liquid crystal pixels.

Figure 3:
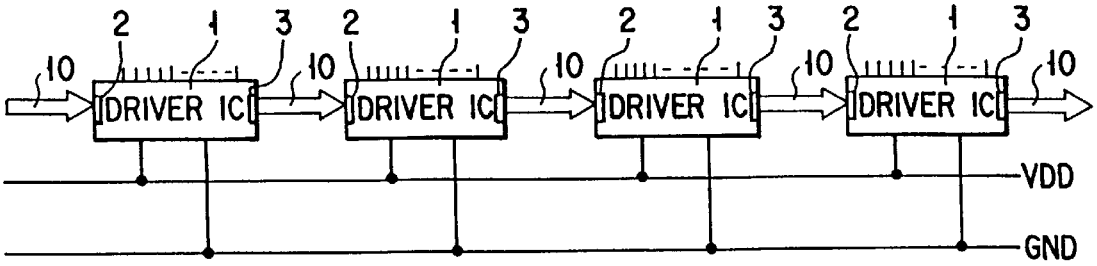
FIG. 3 is a block diagram schematically showing the structure of the signal line driver shown in FIG. 2.

FIG. 3 schematically shows the structure of the signal line driver 23. Each signal line driver 23 includes a plurality of driver ICs 1 arranged as shown in FIG. 3. These driver ICs 1 are semiconductor bare chips which are connected commonly to power lines VDD and GND formed along the driver ICs and connected in cascade by inter-module wirings formed therebetween. The inter-module wirings 10 are used to transmit the pixel data signal, the clock signal and various control signals via each driver IC 1. Each driver IC 1 receives these signals via an input pad portion 2, sequentially supplies the pixel data signal to the predetermined number of signal lines in synchronism with the clock signal under the control of the control signals, and further shapes the waveforms of these signals to be output from its output pad portion 3 to the next driver IC 1. It should be noted that the bare chips of driver ICs 1 are covered by an insulating layer together with the power lines VDD and GND in the driver substrate.

Figure 4:
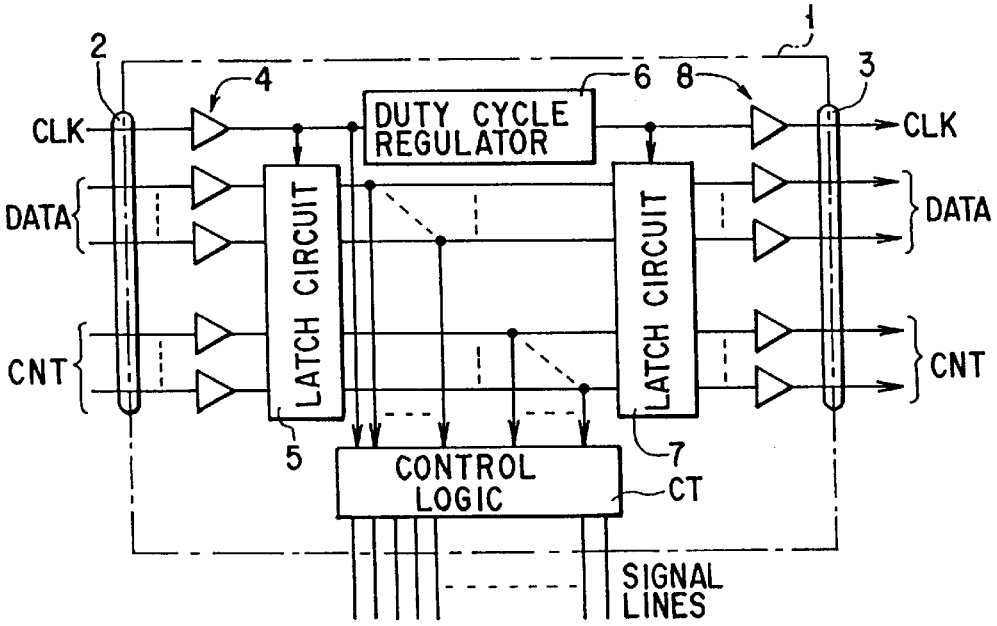
FIG. 4 is a circuit diagram showing in detail the structure of each driver IC illustrated in FIG. 3.

FIG. 4 shows the structure of each driver IC 1 in detail. The inter-module wirings 10 include a clock line CLK for transmitting the clock signal, data lines DATA for transmitting the pixel data signal and control lines CNT for transmitting the control signals. The driver IC 1 includes a first buffer amplifier 4 for amplifying signals supplied to the input pad portion via the clock line CLK. The driver IC 1 also includes data lines DATA, control lines CNT, and a first latch circuit 5 for simultaneously latching the pixel data signal and the control signals output from the first buffer amplifier 4, in response to the clock signal output from the first buffer amplifier 4. A duty cycle regulator 6, regulates the duty ratio with regard to the clock signal output from the buffer amplifier 4. Next, a control logic CT is provided for sequentially supplying the pixel data signal output from the first latch circuit 5 to the predetermined number of signal lines, in response to the clock signal output from the first buffer amplifier 4. Also provided is a second latch circuit 7 for simultaneously latching the pixel data signal and the control signal output from the first latch circuit 5, in response to the clock signal output from the duty cycle regulator 6, and a second buffer amplifier 8 for amplifying the pixel data signal and the control signals output from the second latch circuit 7, and the clock signal output from the duty cycle regulator 6, to output them to the output pad portion 3.

More specifically, the pixel data signal, the clock signal and the various control signals are supplied via the input pad portion 3 into a driver IC 1, where the signals are distributed into two transmission paths. One of the transmission paths is used to supply these signals to the control logic CT, and the other is used to shape the waveforms of these signals and output the shaped signals to the next driver IC 1 via its output pad portion 3. The control logic CT includes a shift register circuit for sequentially selecting the predetermined number of signal lines by shifting, for example, a start pulse supplied as the control signal, in synchronism with the clock signal, and an output circuit for setting the signal line selected by the shift register at a potential corresponding to the pixel data signal. The waveforms of the pixel data signal and the control signals are shaped by the latch circuits 5 and 7, and that of the clock signal is shaped by the duty cycle regulator 6. In the latch circuits 5 and 7, the pixel data signal and the control signals are latched with reference to the timing of the clock signal, so as to recover the signals distorted during transmission. The duty cycle regulator 6 performs an operation of shaping the waveform of the clock signal, for example, while adjusting the threshold value thereof to trace the average value of the clock signal voltage, and outputting the clock signal whose duty ratio is maintained at about 1:1 to the next driver IC 1.

Figure 5:
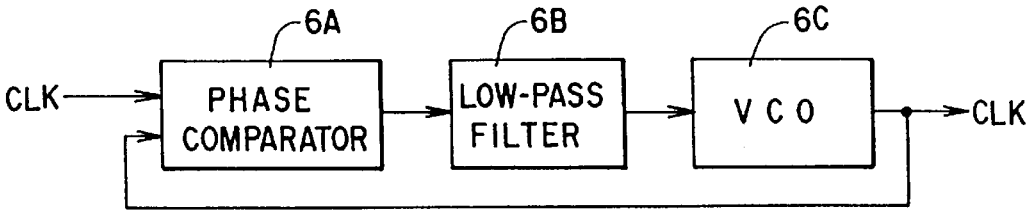
FIG. 5 is a circuit diagram showing the structure of a PLL circuit used as a duty cycle regulator shown in FIG. 4.

The duty cycle regulator 6 is made of, for example, a Phase Locked Loop (PLL) circuit as shown in FIG. 5. The PLL circuit includes an edge operation frequency phase comparator 6A, a low pass filter 6B and a voltage controlled variable frequency oscillator 6C. The edge operation frequency phase comparator 6A serves to compare an input clock signal from the buffer amplifier 4 and an output clock signal from the oscillator 6C in terms of phase, and generate an error voltage corresponding to a phase difference therebetween. The error voltage is supplied as a control voltage to the oscillator 6C via the low-pass filter so as to shift the phase of the output clock signal.

Figure 6:
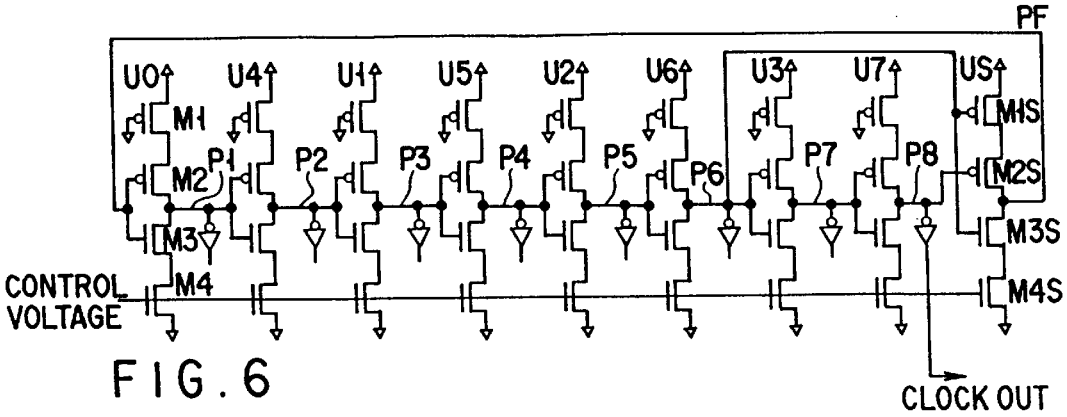
FIG. 6 is a circuit diagram showing the structure of a voltage controlled variable frequency oscillator shown in FIG. 5.
Figure 7:
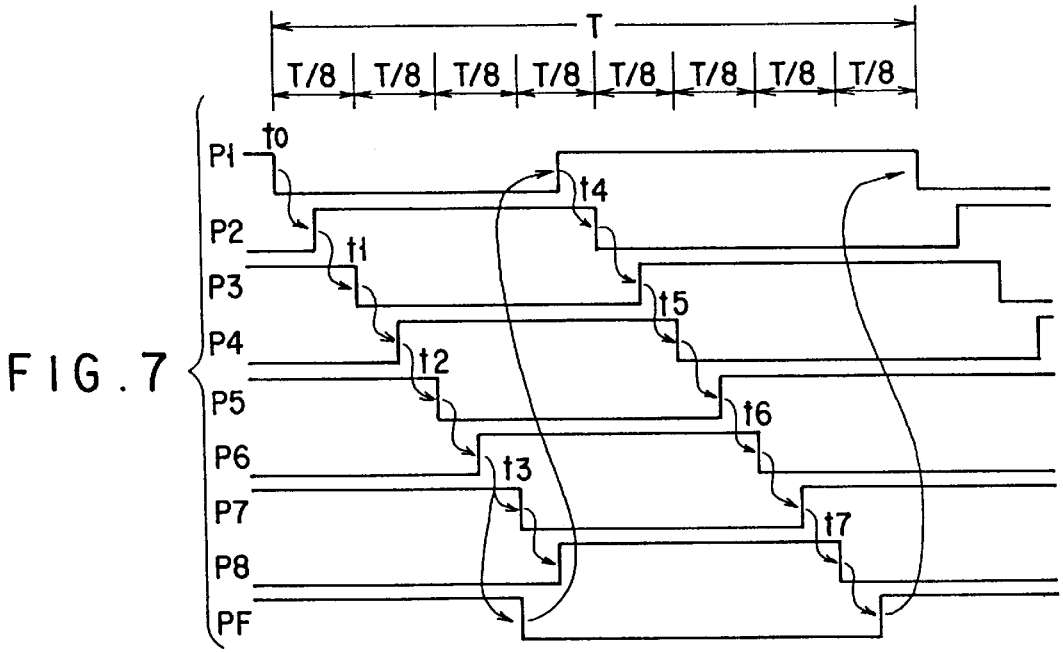
FIG. 7 is a time chart illustrating the operation of the voltage controlled variable frequency oscillator shown in FIG. 5.

The voltage controlled variable frequency oscillator 6C includes a plurality of CMOS inverters connected in series, for example, as shown in FIG. 6. The CMOS inverters include MOS transistors which are biased by the control voltage supplied from the low-pass filter 6B and control discharge currents from output terminals P1 to P8 and PF. The output terminal PF of the final CMOS inverter is connected to the input terminal of the first CMOS inverter so as to feed the output clock signal back thereto. With this structure, all the CMOS transistors periodically generate output clock signals from the output terminals P1 to P8 and PF as shown in FIG. 7. The phases of the output clock signals are shifted at a constant rate determined to trace a change in the control voltage.

Figure 8:
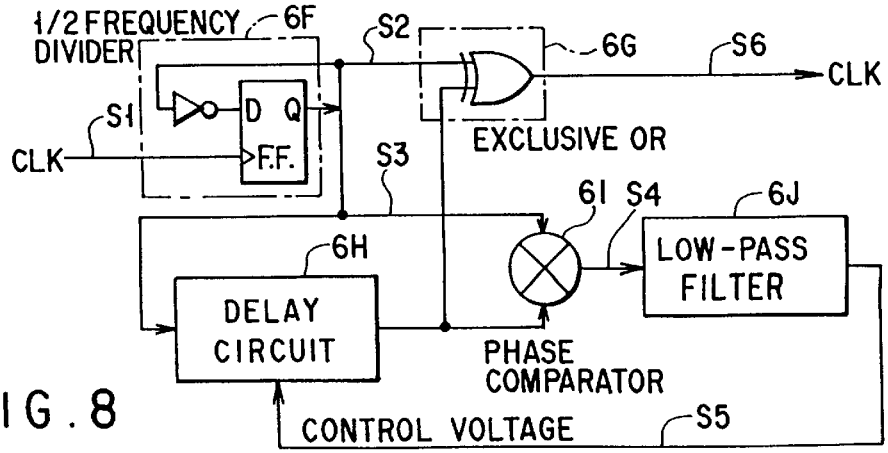
FIG. 8 is a circuit diagram showing the structure of a DLL circuit used as the duty cycle regulator shown in FIG. 4.

Further, the duty cycle regulator 6 is made of a Delay Locked Loop (DLL) circuit, for example, as shown in FIG. 8. The DLL circuit includes a ½ frequency divider 6F, an exclusive OR gate 6G, a voltage controlled delay circuit 6H, a multiplying phase comparator 6I and a low-pass filter 6J. The ½ frequency divider 6F serves to divide an input clock signal from the buffer amplifier 4 into ½ frequency, and supply the divided signal to the exclusive OR gate 6G, the voltage controlled delay circuit 6H and the multiplying phase comparator 6I. The delay circuit 6H serves to delay a clock signal from the divider 6F, and supply it to the phase comparator 6I and the exclusive OR gate 6G. The phase comparator 6I compares the clock signal from the divider 6F and the clock signal from the delay circuit 6H, with each other, and generates an error voltage on the basis of the phase difference. The error voltage is supplied to the delay circuit 6H via the low pass filter 6J as a control voltage used for increase or decrease the delay time. The exclusive OR gate 6G generates an output clock signal corresponding to an exclusive OR of the clock signal from the divider 6F and the clock signal from the delay circuit 6H.

Figure 9:
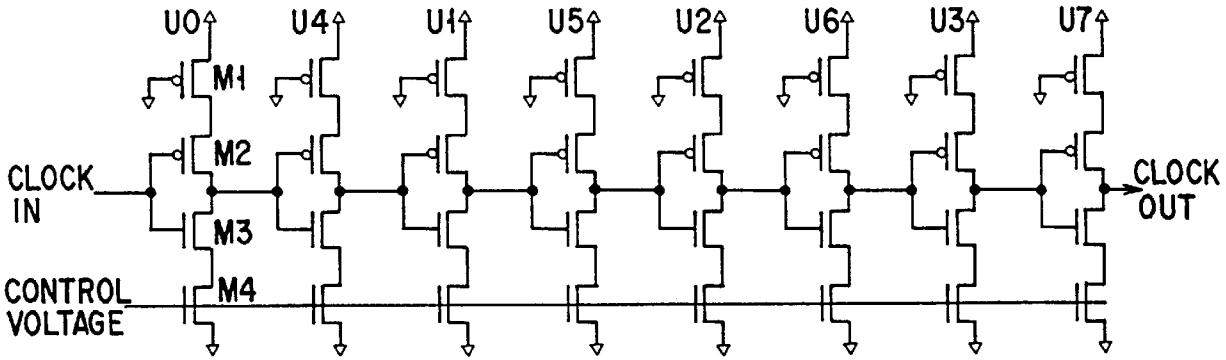
FIG. 9 is a circuit diagram showing the structure of a voltage controlled delay circuit shown in FIG. 8.

The voltage controlled delay circuit 6H includes a plurality of CMOS inverters connected in series, for example, as shown in FIG. 9. These CMOS inverters include MOS transistors which are biased by the control voltage supplied from the low pass filter 6J and control discharge currents from the respective output terminals. The clock signal from the ½ frequency divider 6G is supplied to the input terminal of the first CMOS inverter. Thus, all the CMOS transistors generate output clock signals periodically from the output terminals. The phases of these output clock signals are shifted at a constant rate determined to trace a change in the control voltage.

Figure 10:
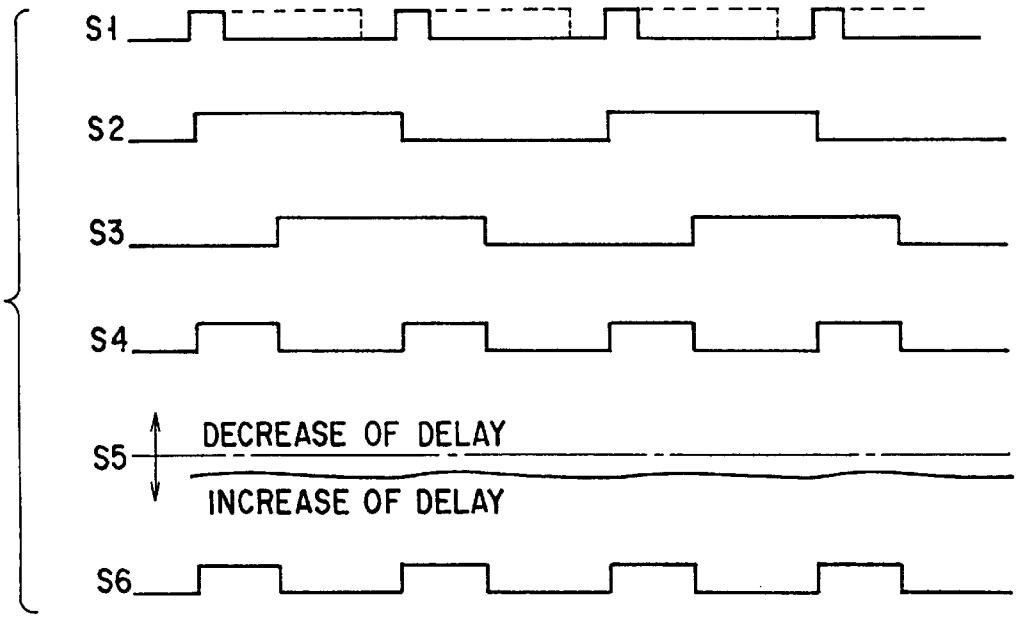
FIG. 10 is a time chart illustrating the operation of the DLL circuit shown in FIG. 8.

In the DLL circuit, outputs S1 to S6 from the ½ frequency divider 6F, the exclusive OR gate 6G, the voltage controlled delay circuit 6H, the multiplying phase comparator 6I and the low pass filter 6J vary as can be seen in FIG. 10. Consequently, the clock signal has a duty ratio maintained at substantially 1:1 and is output to the next driver IC 1.

With the liquid crystal display device according to the embodiment, the timing of the clock signal can be regulated while reducing distortion of the pixel data signal. Therefore, the signal transmission capability can be maintained regardless of an increase in the number of driver ICs 1. Further, since the liquid crystal display device employs the inter-module wirings 10 to transmit the pixel data signal, the clock signal and various control signals, a required wiring area for signal transmission is reduced. Accordingly, a larger screen size or a higher resolution can be achieved without unnecessarily increasing the dimensions of the frame region or the manufacturing cost.

Figure 11:
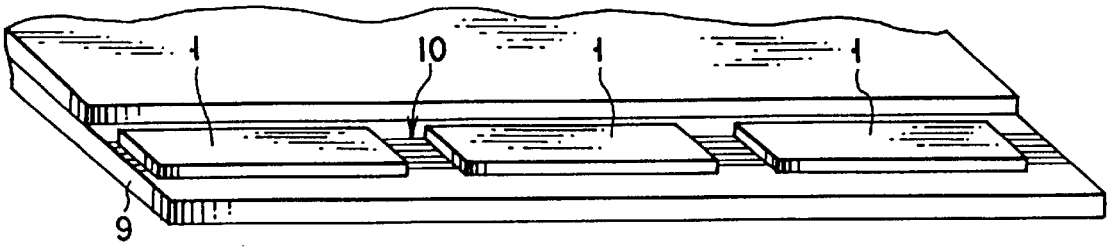
FIG. 11 is a perspective view showing the wiring state of the case where the driver ICs shown in FIG. 3 are mounted on the array substrate.

In the above embodiment, the driver ICs 1 of each signal line driver 23 are formed on the corresponding driver substrate. However, it is also possible that the driver ICs can be formed on the periphery of the array substrate 9, and the thin films of the inter-module wirings 10 are formed between the driver ICs 1 by the COG mount technique as shown in FIG. 11. These inter-module wirings 10 connect the driver ICs 1 in cascade, so as to transmit the pixel data signal, the clock signal and various control signals via each driver IC 1. With the liquid crystal display device having the above-described structure, a high signal transmission speed having a clock frequency of 25 MHz to 65 MHz, can be achieved. Consequently, ten or more driver ICs can be connected in cascade so as to obtain a larger screen size or a higher resolution.

Alternatively, the inter-module wirings are applicable not only to the signal line driver 23 but also to the scanning line driver 24.

To avoid complication, the above-described embodiment is described regarding only the power voltage supplied via the power lines VDD and GND commonly to the circuit components of the driver IC 1. However, in practice, a power voltage for driving the pixel electrodes according to the pixel data signal and a reference power voltage for driving the common electrode are required in addition to the power voltage supplied commonly.

Figure 12:
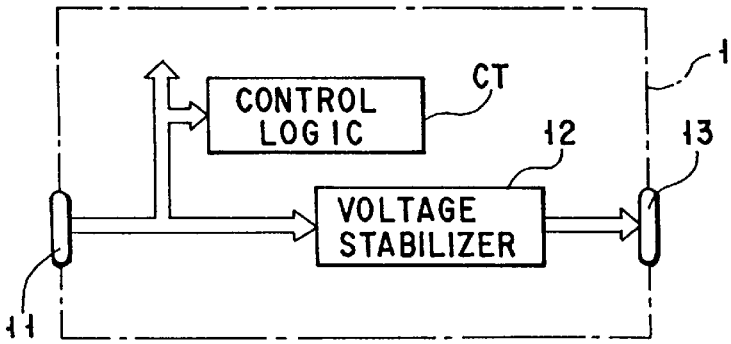
FIG. 12 is a circuit diagram illustrating a voltage stabilizing circuit added to each driver IC in the case where the inter-module wiring shown in FIG. 3 is applied to a power line.

In the case where the outline dimensions of the liquid crystal panel 20 and the voltage drop due to the wiring resistance are relatively small, the inter-module wirings 10 is applicable to power lines for supplying the aforementioned power voltages. In this case, a voltage stabilizer 12 is added to each driver IC 1 together with a power input pad portion 11 and a power output pad portion 13 as can be seen in FIG. 12. Various power voltages are input to the driver IC 1 via the power input pad portion 11, and then supplied to circuit components such as the buffer amplifier 4, the latch circuit 5, the duty cycle regulator 6, the latch circuit 7, the buffer amplifier 8 and the control logic CT, as well as to the voltage stabilizer 12. These power voltages are stabilized by the voltage stabilizer 12, and output to the next driver IC via the power output pad. It should be noted that the above voltage stabilizer 12 may be separately provided for each power voltage in each driver IC 1.

In the case where such a voltage stabilizer 12 as described above is incorporated in each driver IC 1, and the inter-module wirings 10 include all the power lines in addition to the signal lines for the clock signal, pixel data signal and other control signals, a required wiring area for the signal driver 23 can be reduced in comparison with the case where external bus lines are provided to supply the power voltages.

Figure 13:
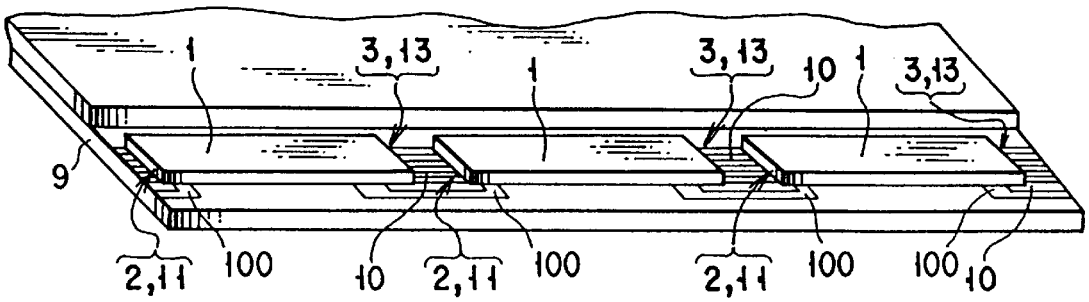
FIG. 13 is a perspective view showing the wiring state of the case where the driver ICs having the voltage stabilizing circuits shown in FIG. 12 are mounted on the array substrate.

Further, in the case where driver ICs 1 have a rectangular shape in which an aspect ratio is set to 1:5, the input pad portion 2 and the power input pad portion 11 are arranged on one short side, and the output pad portion 3 and the power output pad portion 13 are arranged on the other short side, the driver ICs can be mounted, as shown in FIG. 13, on the periphery of the array substrate 9 with the inter-module wirings 10 extending in substantially straight, so as to effectively decrease the gap between adjacent driver ICs 1.

It should be noted that in FIG. 13, inter-module wiring chips 100 each having the inter-module wirings 10 formed on a flexible resin film are assigned to gaps between the driver ICs 1, and these driver ICs 1 are connected in cascade by the inter-module wirings 10 of the inter-module wiring chips 100.

In the case where the outline dimensions of the liquid crystal panel 20 and the voltage drop due to the wiring resistance are relatively large, external common bus lines may be used to directly supply only the power voltage for driving the pixel electrodes and the reference power voltage for the common electrode to each driver IC. This structure is available to reduce the number of external common bus lines. In other words, since the common bus lines do not occupy a large area, an increase in the dimensions of the frame region can be suppressed.

In the above-described modification, the signal line driver IC 1 is constituted such that signals are transmitted without using external bus lines as much as possible. In the case where the driver ICs 1 are connected in cascade by the inter-module wirings, every transmitted signal is distorted each time it passes one driver IC 1; however, the distortion is canceled by shaping the waveform of the transmitted signal in each driver. Therefore, the number of driver ICs 1 is not limited just because of the distortion occurring in signal transmission.

Further, the voltage stabilizer 12 is provided for each driver IC 1 and maintains the power voltages to be stable against the voltage variation caused by an external factor or by an internal load in the driver IC 1. This enables that inter-module wirings are used to supply the power voltages, in place of common bus lines.

What is claimed is:

1. A liquid crystal display device comprising:

a liquid crystal panel having a matrix array of liquid crystal pixels, a plurality of scanning lines respectively formed along rows of said liquid crystal pixels, and a plurality of signal lines respectively formed along columns of said liquid crystal pixels;

wherein said liquid crystal panel includes a glass plate on which said signal lines are formed; and a driving circuit for driving each of said scanning lines to select one of the rows of the liquid crystal pixels and including at least a signal line driver, the signal line driver being adapted to sequentially drive said signal lines to control voltages across the selected rows of liquid crystal pixels;

wherein said signal line driver includes a plurality of interconnected driver ICs, said driver ICs being formed of bare semiconductor chips connected in cascade by inter-module wirings formed on said glass plate, each IC being configured for driving a predetermined number of the signal lines; and wherein said plurality of driver ICs are configured to transmit at least clock and display signals, each driver IC including:

a clock waveform shaping circuit configured for regulating a duty ratio of the clock signal;

a first transmission path for (i) supplying the clock signal to the clock waveform shaping circuit, thus producing a regulated clock-signal, and (ii) providing the regulated clock signal to a clock line of the inter-module wirings as an input to a next one of said plurality of driver ICs; and a second transmission path for sequentially obtaining voltages of the display signal in synchronism with the clock signal and supplying the obtained voltages of the display signal to the predetermined number of signal lines.

2. A liquid crystal display device according to claim 1, wherein said clock waveform shaping circuit contains a duty cycle regulator for regulating the duty ratio of the clock signal to 1:1.

3. A liquid crystal display device according to claim 1, wherein said duty cycle regulator is formed of a phase locked loop circuit.

4. A liquid crystal display device according to claim 1, wherein said duty cycle regulator is formed of a delay locked loop circuit.

* * * * *